US008185033B2

(12) United States Patent
Jeon

(10) Patent No.: US 8,185,033 B2
(45) Date of Patent: May 22, 2012

(54) PHOTOSENSITIVE BODY UNIT AND IMAGE FORMING APPARATUS HAVING THE SAME

(75) Inventor: In Cheol Jeon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 813 days.

(21) Appl. No.: 12/190,770

(22) Filed: Aug. 13, 2008

(65) Prior Publication Data

US 2009/0214254 A1 Aug. 27, 2009

(30) Foreign Application Priority Data

Feb. 21, 2008 (KR) ..... 10-2008-0015803

(51) Int. Cl.
*G03G 21/12* (2006.01)

(52) U.S. Cl. ..... 399/360

(58) Field of Classification Search ..... 399/111, 399/119, 120, 360
See application file for complete search history.

(56) References Cited

U.S. PATENT DOCUMENTS

| | | | | |
|---|---|---|---|---|
| 5,139,176 | A | 8/1992 | Reindl et al. | |
| 6,782,221 | B2 * | 8/2004 | Saito et al. | 399/109 |
| 7,822,366 | B2 * | 10/2010 | Jeon et al. | 399/223 |
| 2003/0049045 | A1 | 3/2003 | Sano et al. | |
| 2005/0002683 | A1 | 1/2005 | Saito et al. | |
| 2006/0165430 | A1 * | 7/2006 | Gumbe | 399/100 |
| 2009/0214248 | A1 * | 8/2009 | Jeon et al. | 399/90 |

FOREIGN PATENT DOCUMENTS

| | | |
|---|---|---|
| JP | 07-168507 | 7/1995 |
| JP | 08123297 | 5/1996 |
| JP | 2005-121765 | 5/2005 |
| KR | 2005-5045 | 1/2005 |

OTHER PUBLICATIONS

Machine Translation of JP 07-168507 A obtained on Apr. 21, 2011.*
European Search Report issued May 7, 2010 in EP Application No. 08168201.5.
Russian Decision to Grant issued Nov. 2, 2009 in RU Application No. 2008135215.
European Office Action Issued Sep. 27, 2010 in EP Application No. 08168201.5.

* cited by examiner

*Primary Examiner* — David Gray
*Assistant Examiner* — Gregory H Curran
(74) *Attorney, Agent, or Firm* — Stanzione & Kim, LLP

(57) ABSTRACT

An image forming apparatus having an improved photosensitive body unit capable of efficiently utilizing an inner space of the image forming apparatus. The image forming apparatus includes a photosensitive body unit having a photosensitive body housing and a photosensitive body mounted in the photosensitive body housing. The photosensitive body housing includes a first developer storage part to store a developer collected from the photosensitive body, a second developer storage part to store a developer conveyed from the first developer storage part, and a light window provided so that light can be scanned to the photosensitive body. The light window is positioned between the first developer storage part and the second developer storage part. Developer paths are provided on outer side portions of the light window to connect the first developer storage part and the second developer storage part.

25 Claims, 5 Drawing Sheets

PHOTOSENSITIVE BODY UNIT AND IMAGE FORMING APPARATUS HAVING THE SAME

CROSS-REFERENCE TO RELATED APPLICATIONS

This application claims priority under 35 U.S.C. §119(a) from Korean Patent Application No. 2008-0015803, filed on Feb. 21, 2008 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus which can be reduced in bulk by improving a structure of a photosensitive body unit.

2. Description of the Related Art

A conventional image forming apparatus is an apparatus that prints an image onto a printing medium according to an input image signal. A conventional image forming apparatus can be classified as a printer, a copying machine, a fax machine, a multi-function printer which has multiple functions of printing, scanning, copying and faxing, etc.

An electrophotographic type image forming apparatus is a particular type of image forming apparatus that scans light to a photosensitive body charged to a predetermined electric potential to form an electrostatic latent image on a surface of the photosensitive body and supplies a developer to the electrostatic latent image to form a visible image. The visible image formed on the photosensitive body is directly transferred onto a printing medium, or is transferred onto a printing medium via an intermediate transfer unit. The image transferred onto the printing medium is fused to the printing medium through a fusing process.

In the printing operation, the visible image on the photosensitive body is not totally transferred onto the printing medium or the intermediate transfer unit. A portion of the developer remains on the photosensitive body. The residual waste developer on the photosensitive body is collected by a waste developer collecting device, and is stored in a waste developer storage container.

An example of an image forming apparatus having a waste developer collecting device is disclosed in Korean Patent Laid-open Publication No. 2005-0005045.

The disclosed image forming apparatus includes a photosensitive drum, a cleaning unit to clean a residual waste developer on the photosensitive drum, a conveying pipe to convey the waste developer removed from the photosensitive drum, and a collecting container to store the waste developer conveyed through the conveying pipe.

The photosensitive drum and the cleaning unit are provided in one unit, and are mounted in a main body of the image forming apparatus. The waste developer collecting container is provided separately from the photosensitive drum unit, and is mounted in the main body.

However, because the waste developer collecting container is mounted in the main body, separately from the photosensitive drum unit, and the conveying pipe is mounted between the photosensitive drum unit and the waste developer collecting container, the disclosed conventional image forming apparatus has a complicated inner structure, and thus has difficulty in being reduced in size and therefore remains bulky.

Also, when the photosensitive drum is worn or the waste developer collecting container is filled with the waste developer, the disclosed conventional image forming apparatus inconveniences a user by forcing the user to replace a photosensitive drum and empty a waste developer collecting container separately.

SUMMARY OF THE INVENTION

The present general inventive concept a photosensitive body unit which is improved so that an inner space of an image forming apparatus can be efficiently utilized, and an image forming apparatus having the same.

The present general inventive concept also provides a photosensitive body unit which enhances user's convenience because a user does not need to separately dispose of a developer collected from a photosensitive body, and an image forming apparatus having the same.

Additional aspects and/or utilities of the general inventive concept will be set forth in part in the description which follows and, in part, will be obvious from the description, or may be learned by practice of the general inventive concept.

The foregoing and/or other aspects and utilities of the present general inventive concept are achieved by providing a photosensitive body unit, including a photosensitive body, a first developer storage part to store a developer collected from the photosensitive body, a second developer storage part to store a developer conveyed from the first developer storage part, and a light window provided between the first developer storage part and the second developer storage part so that light can be scanned to the photosensitive body.

The photosensitive body unit may further include developer paths provided near the light window so that a developer stored in the first developer storage part can be moved to the second developer storage part.

The photosensitive body unit may further include a first developer conveying member disposed in the first developer storage part, and a second developer conveying member disposed in the second developer storage part.

The second developer conveying member may be operated interlockingly with the first developer conveying member.

The first developer conveying member may perform a rotating motion, and the second developer conveying member may perform a rectilinear motion.

The photosensitive body unit may further include a photosensitive body housing to rotatably support the photosensitive body. The first developer storage part and the second developer storage part may be formed in the photosensitive body housing.

The light window may include a light-transmitting hole formed at a bottom of the photosensitive body housing, and a side wall protruded upward from a periphery of the light-transmitting hole.

The photosensitive body housing may include a knob part.

The photosensitive body housing may include a cover to cover the second developer storage part.

The cover may be formed with a light-transmitting hole so that light having passed through the light window can penetrate the cover.

The cover may be provided with a protruding wall to prevent foreign substances from being introduced into the light window.

The foregoing and/or other aspects and utilities of the present general inventive concept may also be achieved by providing a photosensitive body unit including a photosensitive body housing, a photosensitive body mounted in the photosensitive body housing, a first developer storage part provided in the photosensitive body housing; a second developer storage part provided in the photosensitive body housing, a light-transmitting hole formed at the photosensitive body housing so that light can be scanned to the photosensitive body, and developer paths provided so that a developer stored in the first developer storage part can make a detour to avoid the light-transmitting hole and can move to the second developer storage part.

The developer paths may be respectively formed on both side portions of the light-transmitting hole.

The photosensitive body unit may further include a developer conveying member including at least a portion disposed in the developer paths.

The foregoing and/or other aspects and utilities of the present general inventive concept may also be achieved by providing a developer storage unit including a first developer storage part to store a developer, a second developer storage part to store a developer conveyed from the first developer storage part, and a light window provided between the first developer storage part and the second developer storage part, through which light passes.

The developer storage unit may further include an image carrier to which light passing through the light window is scanned.

The foregoing and/or other aspects and utilities of the present general inventive concept may also be achieved by providing an image forming apparatus, including a photosensitive body unit including a photosensitive body and a photosensitive body housing to rotatably support the photosensitive body, a laser scanning unit to scan light to the photosensitive body, and developing devices to supply a developer to the photosensitive body. The photosensitive body may unit further include a first developer storage part provided in the photosensitive body housing to store a developer collected from the photosensitive body, and a second developer storage part to store a developer moving from the first developer storage part. The photosensitive body housing may include a light-transmitting hole opened so that light scanned from the laser scanning unit can reach the photosensitive body.

The light-transmitting hole may be positioned between the first developer storage part and the second developer storage part.

The laser scanning unit may be disposed below the photosensitive body unit, and the light-transmitting hole may be formed at a bottom of the photosensitive body housing.

The photosensitive body housing may further include a side wall protruded upward from a periphery of the light-transmitting hole.

The photosensitive body unit may further include developer paths provided on outer side portions of the side wall, to connect the first developer storage part and the second developer storage part.

The foregoing and/or other aspects and utilities of the present general inventive concept may also be achieved by providing a developer storage unit, including a developer storage part to store a developer, and a light window formed on the developer storage part to provide a light path therethrough.

The foregoing and/or other aspects and utilities of the present general inventive concept may also be achieved by providing a photosensitive body unit, including a photosensitive body, and a developer storage unit disposed to cover a portion of the photosensitive body, and having a developer storage part to store a developer and a light window formed on the developer storage part to provide a light path therethrough to the photosensitive body.

The foregoing and/or other aspects and utilities of the present general inventive concept may also be achieved by providing an image forming apparatus, including a scanning unit to scan light, a photosensitive body, a developer storage unit disposed between the photosensitive body and the scanning unit and disposed to cover a portion of an outer circumference surface of the photosensitive body, and having a developer storage part to store a developer and a light window formed on the developer storage part to provide a light path therethrough from the scanning unit to the photosensitive body.

The foregoing and/or other aspects and utilities of the present general inventive concept may also be achieved by providing an image forming apparatus, including a photosensitive body unit comprising a storage part to store developer therein, a laser scanning unit (LSU) to emit an image-forming light into the photosensitive body unit, a developer path and a non developer path formed on the developer storage part, and a light window formed in the developer path to allow the image forming light to enter the photosensitive body unit.

The storage part may further include first and second frame parts, such that the light window is disposed between the first and second frame parts to allow the image-forming light to enter the photosensitive body unit.

The image forming apparatus may further include a plurality of developer conveying members disposed in the first and second frame parts to rotatingly or reciprocatingly convey developer from the first frame part to the second frame part.

The photosensitive body unit may further include a photosensitive body to receive the image-forming light and form an electrostatic latent image corresponding to predetermined image information thereupon.

The image forming apparatus may further include a protruding wall disposed on the second frame part to prevent developer from obstructing the image-forming light's entering of the photosensitive body unit.

The foregoing and/or other aspects and utilities of the present general inventive concept may also be achieved by providing an image forming apparatus, including a photosensitive body unit including first and second developer storage parts, a light window disposed between the first and second developer storage parts to allow an image forming light to enter the photosensitive body unit, and first and second developer conveying members respectively disposed in the first and second developer storage parts to convey developer from the first developer storage part to the second developer storage part while bypassing the light window.

The image forming apparatus may further include a plurality of developer paths disposed between the first and second developer storage parts to allow the developer to bypass the light window.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
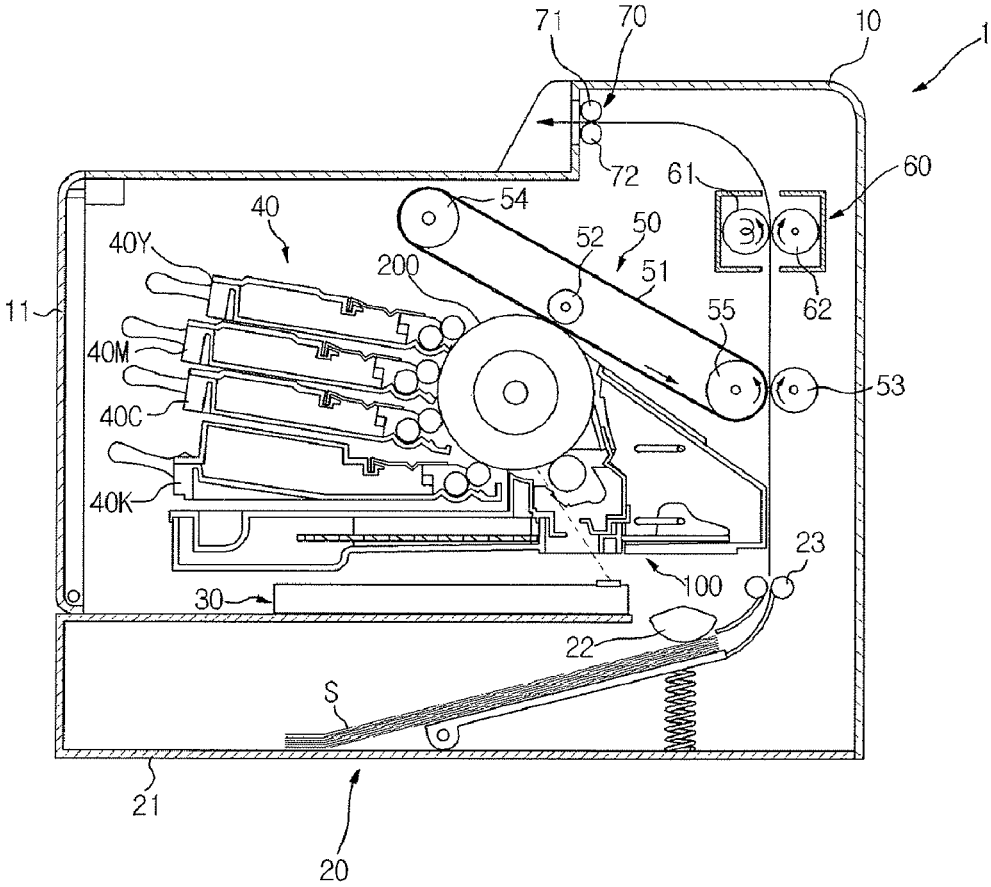
FIG. 1 is a view illustrating a constitution of an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
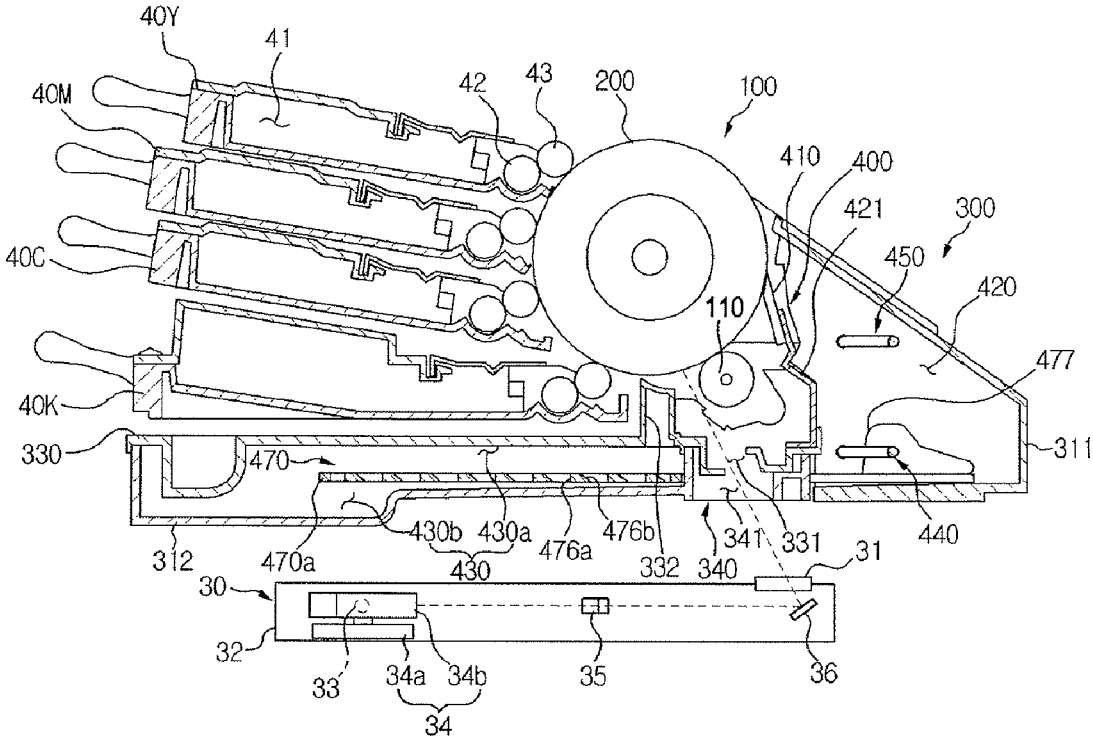
FIG. 2 is a view illustrating a partial constitution of the image forming apparatus illustrated in FIG. 1.

FIG. 1 is a view illustrating a constitution of an image forming apparatus 1 according to an exemplary embodiment of the present general inventive concept, and FIG. 2 is a view illustrating a partial constitution of the image forming apparatus 1 illustrated in FIG. 1.

As illustrated in FIGS. 1 and 2, the image forming apparatus 1 includes a main body 10, a printing medium feeding unit 20, a laser scanning unit (LSU) 30, a photosensitive body unit 100, a developing unit 40, a transfer unit 50, a fusing unit 60 and a printing medium discharge unit 70.

The main body 10 forms an exterior appearance of the image forming apparatus 1, and supports components mounted thereinside. A cover 11 is hingedly coupled to the main body 10 to expose or shield an opened portion of the main body 10. A user can get access to the interior of the main body 10 by opening the cover 11, and can install and/or uninstall the components, such as the photosensitive body unit 100 and the developing unit 40, in/from the main body 10.

The printing medium feeding unit 20 includes a cassette 21 to store a printing medium S, a pickup roller 22 to pick up the printing medium S in the cassette 21 sheet by sheet, and a feeding roller 23 to feed the picked-up printing medium S toward the transfer unit 50.

The laser scanning unit 30 is disposed below the photosensitive body unit 100, and serves to scan light corresponding to image information to a photosensitive body 200. The laser scanning unit 30 includes a case 32 having a light transmitting member 31 so that light can be irradiated outside, and a scanning optical system mounted in the case 32.

The scanning optical system includes a light source 33 to emit light according to an image signal, an optical deflector 34 to deflect the light emitted from the light source 33, an f-theta (fθ) lens 35 to correct aberrations included in the light deflected from the optical deflector 34, and a mirror 36 to reflect the light passing through the f-theta lens 35 toward the photosensitive body 200.

The optical deflector 34 includes a driving motor 34*a*, and a polygon mirror 34*b* which is rotated by the driving motor 34*a*. The polygon mirror 34*b* has a plurality of reflecting surfaces at a side portion thereof to deflection-scan the light incident from the light source 33.

The light emitted from the light source 33 is deflected by the rotating polygon mirror 34*b*, and is reflected toward the light transmitting member 31 by the mirror 36 via the f-theta lens 35. The light reflected from the mirror 36 passes through the light transmitting member 31, and is irradiated to the outside of the case 32. Then, the light is transmitted to the photosensitive body 200, and forms an electrostatic latent image on a surface of the photosensitive body 200.

The photosensitive body unit 100 includes a photosensitive body housing 300, and the aforementioned photosensitive body 200 which is rotatably mounted in the photosensitive body housing 300. The photosensitive body 200 serves as an image carrier which holds an electrostatic latent image formed by the laser scanning unit 30 and a visible image formed by the developing unit 40.

The photosensitive body unit 100 is removably mounted in the main body 10, so that when the photosensitive body unit 100 is out of order or worn, a user can repair or replace the photosensitive body unit 100 by opening the cover 11.

A charging roller 110 is mounted in the photosensitive body housing 300. The photosensitive body 200 is charged to a predetermined electric potential by the charging roller 110 before the laser scanning unit 30 scans light to the photosensitive body 200.

A developer collecting device 400 is mounted in the photosensitive body housing 300. After the developing and transfer processes of one cycle are completed, the developer collecting device 400 collects and stores a residual developer on the surface of the photosensitive body 200. The developer collecting device 400 is formed integrally with the photosensitive body unit 100. The photosensitive body unit 100 may also be referred to as a developer storage unit 100.

As such, if the developer collecting device 400 is formed integrally with the photosensitive body unit 100, it is not necessary to mount an additional ink collecting container in the main body 10. Accordingly, it is possible to reduce a size of the image forming apparatus 1. The constitution of the photosensitive body unit 100 related to the developer collecting device 400 will be explained in detail later.

The developing unit 40 supplies a developer to the photosensitive body 200, on which an electrostatic latent image is formed, to form a visible image. The developing unit 40 includes four developing devices 40Y, 40M, 40C and 40K, in which developers of different colors, e.g., yellow (Y), magenta (M), cyan (C) and black (K), are respectively stored.

Each of the developing devices 40Y, 40M, 40C and 40K includes a developer storage part 41, a supply roller 42 and a developing roller 43. The developer storage part 41 stores a developer to be supplied to the photosensitive body 200. The supply roller 42 supplies the developer stored in the developer storage part 41 to the developing roller 43. The developing roller 43 attaches the developer to the surface of the photosensitive body 200, on which an electrostatic latent image is formed, to form a visible image.

The transfer unit 50 includes an intermediate transfer belt 51, a first transfer roller 52 and a second transfer roller 53.

The intermediate transfer belt 51 is supported by support rollers 54 and 55, and operates at the same velocity as a linear velocity of the photosensitive body 200. The first transfer roller 52 opposes the photosensitive body 200 while the intermediate transfer belt 51 is interposed between the first transfer roller 52 and the photosensitive body 200, and transfers the visible image formed on the photosensitive body 200 onto the intermediate transfer belt 51.

The second transfer roller 53 opposes the support roller 55 while the intermediate transfer belt 51 is interposed between the second transfer roller 53 and the support roller 55. While the image is transferred onto the intermediate transfer belt 51 from the photosensitive body 200, the second transfer roller 53 is spaced apart from the intermediate transfer belt 51.

When the image is completely transferred onto the intermediate transfer belt 51 from the photosensitive body 200, the second transfer roller 53 comes into contact with the intermediate transfer belt 51 with a predetermined pressure. When the second transfer roller 53 contacts the intermediate transfer belt 51, the image on the intermediate transfer belt 51 is transferred onto the printing medium.

The fusing unit 60 includes a heating roller 61 having a heat source, and a press roller 62 mounted while opposing the heating roller 61. While the printing medium passes between the heating roller 61 and the press roller 62, the image is fused to the printing medium by heat transferred from the heating roller 61 and pressure exerted between the heating roller 61 and the press roller 62.

The printing medium discharge unit 70 includes a discharge roller 71 and a discharge backup roller 72, so as to discharge the printing medium having passed through the fusing unit 60 to the outside of the main body 10.

The operation of the above-constituted image forming apparatus 1 will now be explained. At the beginning of the printing operation, the surface of the photosensitive body 200 is uniformly charged by the charging roller 110. The laser scanning unit 30 irradiates light corresponding to image information of any one color, e.g., yellow, to the uniformly charged surface of the photosensitive body 200, and an electrostatic latent image corresponding to the yellow image is formed on the photosensitive body 200.

A developing bias is applied to the developing roller 43 of the yellow developing device 40Y, and the yellow developer is attached to the electrostatic latent image. The electrostatic latent image is developed into a yellow visible image on the photosensitive body 200. The visible image is transferred onto the intermediate transfer belt 51 by the first transfer roller 52.

If the yellow visible image corresponding to one page is completely transferred, the laser scanning unit 30 scans light corresponding to image information of another color, e.g., magenta, to the photosensitive body 200 to form an electrostatic latent image corresponding to the magenta image. The magenta developing device 40M supplies the magenta developer to the electrostatic latent image to develop the electrostatic latent image into a magenta visible image. The magenta visible image formed on the photosensitive body 200 is transferred onto the intermediate transfer belt 51 by the first transfer roller 52, and is overlapped with the yellow visible image which has been already transferred.

Thereafter, if the visible images of cyan and black are sequentially transferred onto the intermediate transfer belt 51 through the same procedures as above, a color visible image is formed on the intermediate transfer belt 51 by the visible images of yellow, magenta, cyan and black being overlapped. The color visible image is transferred onto the printing medium passing between the intermediate transfer belt 51 and the second transfer roller 53. Then, the printing medium is discharged to the outside of the main body 10 via the fusing unit 60 and the printing medium discharge unit 70.

In the above image forming process, when the image on the photosensitive body 200 is transferred onto the intermediate transfer belt 51, a portion of the developer remains on the photosensitive body 200. In order to perform the developing and transfer processes of the next cycle, the residual developer on the photosensitive body 200, i.e., the waste developer, should be totally removed. To achieve this, the image forming apparatus according 1 to the present general inventive concept includes the developer collecting device 400.

Hereinafter, a constitution of the photosensitive body unit 100 and the developer collecting device 400 provided in the photosensitive body unit 100 will be explained.

Figure 3:
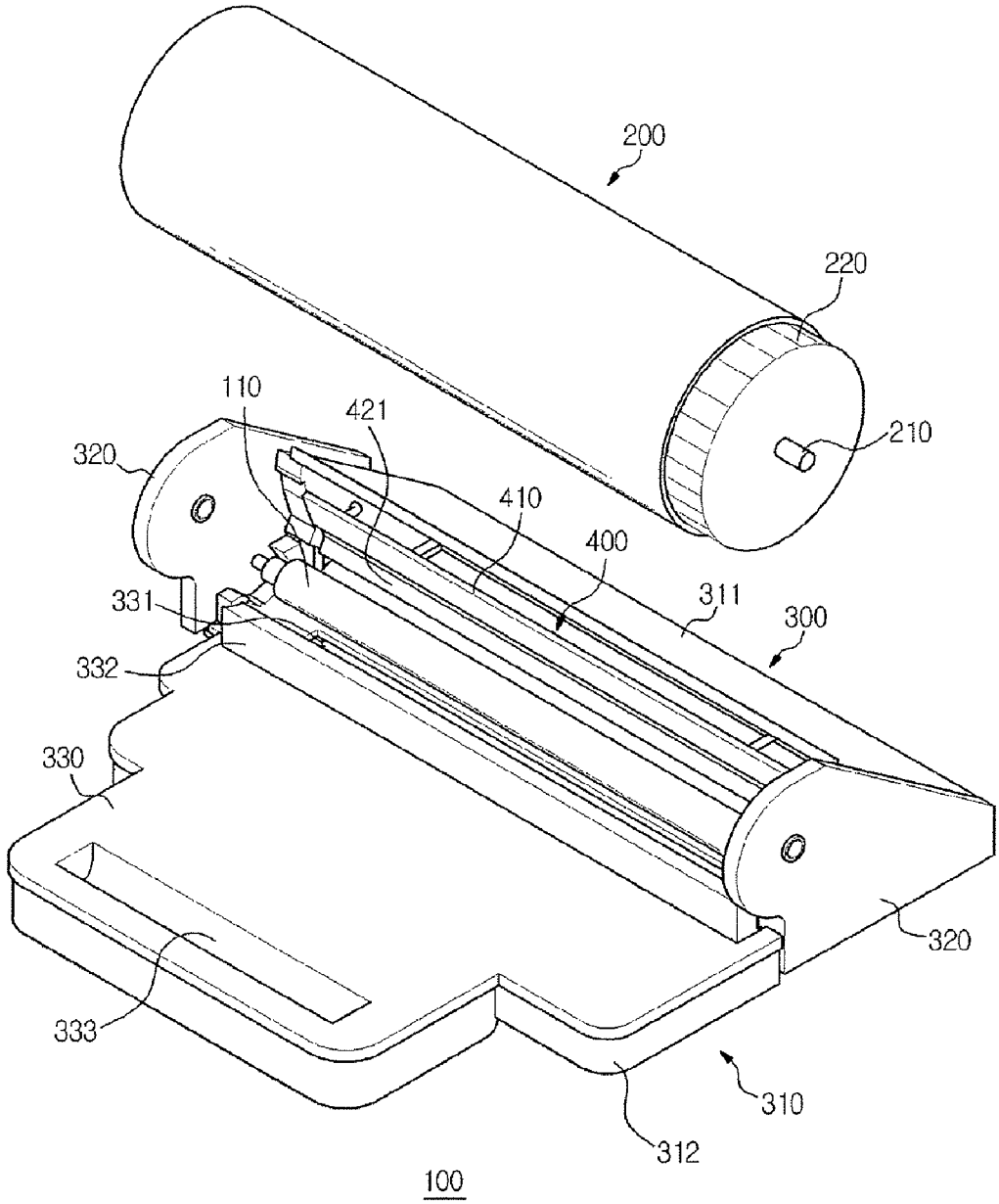
FIG. 3 is a perspective view illustrating a photosensitive body unit of the image forming apparatus according to an exemplary embodiment of the present general inventive concept.
Figure 4:
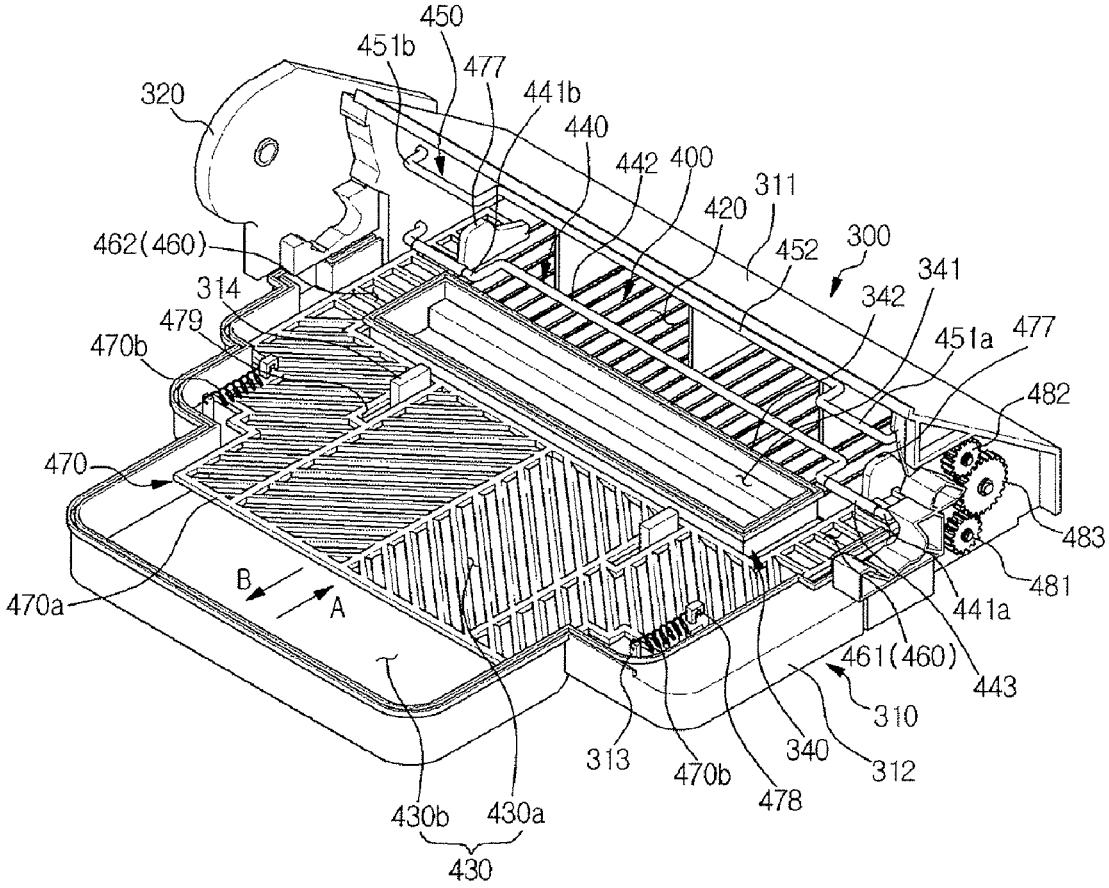
FIG. 4 is a perspective view illustrating an inner constitution of a photosensitive body housing of the image forming apparatus according to an exemplary embodiment of the present general inventive concept.

FIG. 3 is a perspective view illustrating the photosensitive body unit 100 of the image forming apparatus 1 according to an exemplary embodiment of the present general inventive concept, and FIG. 4 is a perspective view illustrating the inner constitution of the photosensitive body housing of the image forming apparatus 1 according to an exemplary embodiment of the present general inventive concept.

As illustrated in FIGS. 2 through 4, the photosensitive body unit 100 includes the photosensitive body 200, the photosensitive body housing 300 and the developer collecting device 400.

The photosensitive body housing 300 forms an overall exterior appearance of the photosensitive body unit 100. The photosensitive body housing 300 includes a main frame 310 which supports components mounted thereinside, side frames 320 coupled to both sides of the main frame 310, a cover 330 which covers a top of the main frame 310, and a light window 340 through which the light scanned from the laser scanning unit 30 passes.

The developer collecting device 400 includes a cleaning blade 410, a first developer storage part 420, a second developer storage part 430, a first developer conveying member 440, a rotating member 450, developer paths 460 and a developer conveying device 470.

The main frame 310 includes a first frame part 311 which is protruded upward and forms the first developer storage part 420 thereinside, and a second frame part 312 which is extended in a longitudinal direction and forms the second developer storage part 430 thereinside.

The side frames 320 are respectively coupled to both side surfaces of the first frame part 311, and a center shaft 210 of the photosensitive body 200 is rotatably supported by the side frames 320. A photosensitive body gear 220 is mounted to one end portion of the photosensitive body 200, and the photosensitive body gear 220 is engaged with a photosensitive body driving gear (not illustrated) mounted in the main body 10.

A rear portion of the first developer storage part 420 is opened, and a partition wall 421 is mounted to the opened portion of the first developer storage part 420. The cleaning blade 410 is supported by one side portion of the partition wall 421. The cleaning blade 410 is mounted such that one side portion thereof is contacted with the photosensitive body 200, to rake out the residual developer on the surface of the photosensitive body 200. The developer removed by the cleaning blade 410 is stored in the first developer storage part 420.

Inside the first developer storage part 420 are mounted the first developer conveying member 440 and the rotating member 450. The first developer conveying member 440 and the rotating member 450 are arranged in an up/down direction. The rotating member 450 disposed above the first developer conveying member 440 is rotated in the first developer storage part 420, so as to agitate the developer stored in the first developer storage part 420 to prevent clumping of the developer.

The first developer conveying member 440 disposed below the rotating member 450 serves to drive a second developer conveying member 470*a*, which will be described later, and also serves to agitate the developer stored in the first developer storage part 420. The first developer conveying member 440 is mounted so as to perform a rotating motion in the first developer storage part 420. However, the first developer conveying member 440 may be designed to perform a rectilinear or reciprocating motion as needed.

The first developer conveying member 440 has first eccentric shaft portions 441*a* and 441*b* which are eccentric in a first direction from a rotational center thereof, and a second eccentric shaft portion 442 which is eccentric in a second direction. The first eccentric shaft portions 441*a* and 441*b* are respectively disposed on both side edge portions of the first developer storage part 420, and the second eccentric shaft portion 442 is disposed between the first eccentric shaft portions 441*a* and 441*b*.

Similar to the first developer conveying member 440, the rotating member 450 has first eccentric shaft portions 451*a* and 451*b* and a second eccentric shaft portion 452.

A first gear 481 and a second gear 482 are mounted to the side surface of the first frame part 311 of the main frame 310, to transmit a rotational force to the first developer conveying member 440 and the rotating member 450. The first gear 481 is coaxially coupled to a rotating shaft of the first developer conveying member 440, and the second gear 482 is coaxially coupled to a rotating shaft of the rotating member 450. A connecting gear 483 is mounted between the first gear 481 and the second gear 482. The first gear 481 is rotatably engaged with a rotating member driving gear (not illustrated) mounted in the main body 10, and the second gear 482 can be rotated by receiving power from the first gear 481 through the connecting gear 483.

The second developer storage part 430 is disposed in front of the first developer storage part 420, and stores the developer conveyed from the first developer storage part 420.

The second developer storage part 430 includes a first portion 430*a* which has a relatively large width, and a second portion 430*b* which has a width smaller than the first portion 430*a*. The first portion 430*a* is positioned adjacent to the first developer storage part 420, and the second portion 430*b* is positioned in the rear of the first portion 430*a*.

The second portion 430*b* is formed to have a width smaller than the first portion 430*a* in order to avoid interference with other components mounted near the photosensitive body unit 100 and to efficiently utilize an inner space of the main body 10. The second portion 430*b* is formed to have a thickness larger than the first portion 430*a* in compensation for the width smaller than the width of the first portion 430*a*.

A light window 340 is provided between the first developer storage part 420 and the second developer storage part 430. Developer paths 461 and 462 are respectively provided on both side portions of the light window 340. The light window 340 permits the light scanned from the laser scanning unit 30 to pass through the photosensitive body housing 300 and to reach the photosensitive body 200. The developer stored in the first developer storage part 420 makes a detour to avoid the light window 340, and can move to the second developer storage part 430 through the developer paths 461 and 462.

The light window 340 includes a light-transmitting hole 341 formed at the bottom of the main frame 310, and a side wall 342 protruded upward from the periphery of the light-transmitting hole 341. The side wall 342 prevents the developer stored in the photosensitive body housing 300 from being introduced into the light-transmitting hole 341.

The developer paths 461 and 462 are provided on both side portions of the side wall 342, and are extended along both side surfaces of the side wall 342.

The developer conveying device 470 serves to convey the developer stored in the first developer storage part 420 to the second developer storage part 430. The developer conveying device 470 includes a second developer conveying member 470*a* to convey the developer by its reciprocating motion, and an elastic member 470*b* to elastically bias the second developer conveying member 470*a* in a predetermined direction to move the developer received from the first developer storage part 420 toward a portion away from (or opposite to) the first developer storage part 420 with respect to the light window 340. The elastic member 470*b* may be a spring, piston or any other type of elastic member known in the art.

Figure 5:
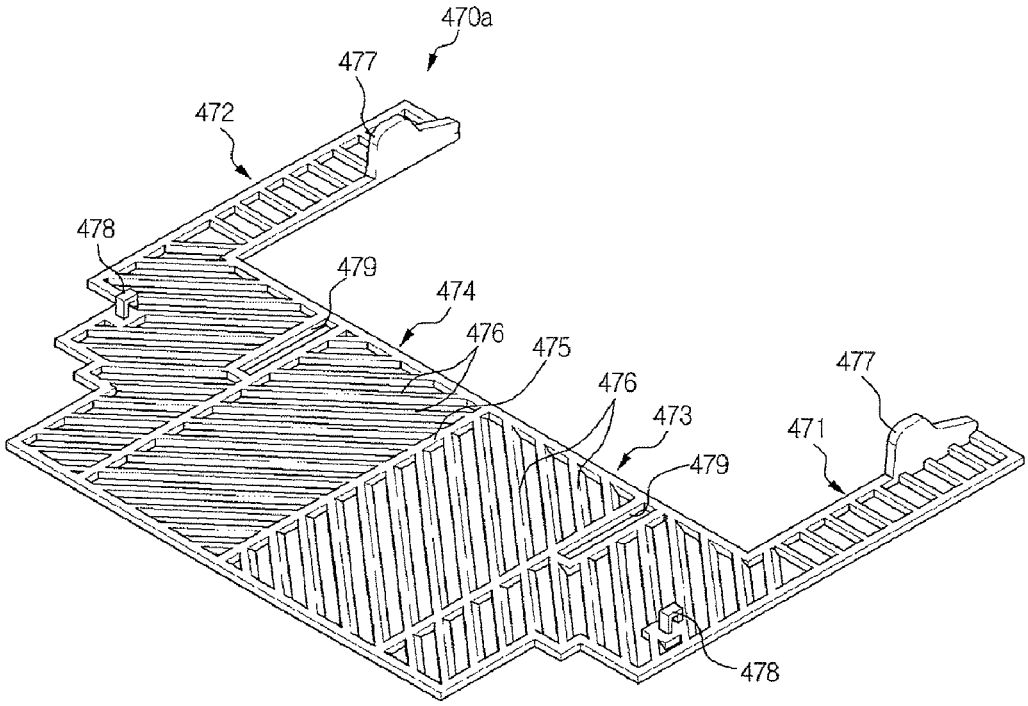
FIG. 5 is a perspective view illustrating a developer conveying member according to the present general inventive concept.

FIG. 5 is a perspective view illustrating the second developer conveying member.

As illustrated in FIGS. 3 through 5, the second developer conveying member 470*a* is formed in a plate shape, and is movably mounted in the photosensitive body housing 300.

The second developer conveying member 470*a* includes a first conveying part 471 and a second conveying part 472 which are respectively extended toward the second developer storage part 430 through the developer paths 461 and 462 on both side edge portions of the first developer storage part 420, and a third conveying part 473 and a fourth conveying part 474 which are positioned in the second developer storage part 430, respectively.

The first conveying part 471 conveys the developer through the developer path 461 formed on one side portion of the light window 340, and the second conveying part 472 conveys the developer through the developer path 462 formed on the opposite side portion of the light window 340.

The third conveying part 473 and the fourth conveying part 474 are arranged parallel to each other from a partition part 475 in a left/right direction. The third conveying part 473 conveys the developer, which is introduced into the first portion 430*a* of the second developer storage part 430 by the first conveying part 471, to the second portion 430*b* of the second developer storage part 430. The fourth conveying part 474 conveys the developer, which is introduced into the first portion 430*a* of the second developer storage part 430 by the second conveying part 472, to the second portion 430*b* of the second developer storage part 430.

The second developer conveying member 470*a* includes a plurality of conveying ribs 476 which are arranged apart from each other. As illustrated in FIG. 2, one side surface 476*a* of each conveying rib 476, which is directed in the developer conveying direction, is formed to be a vertical surface so as to effectively convey the developer. The other side surface 476*b* of each conveying rib 476, which is positioned opposite to the side surface 476*a*, is formed in a slanted surface so as to minimize a potential backward movement of the developer when the second developer conveying member 470*a* is moved in a direction opposite to the developer conveying direction.

Interference portions 477 are respectively provided at an end portion of the first conveying part 471 and an end portion of the second conveying part 472 of the second developer conveying member 470*a*. The interference portions 477 are disposed so as to interfere with the first eccentric shaft portions 441*a* and 441*b* of the rotating first developer conveying member 440. If the interference portions 477 interfere with the rotating first eccentric shaft portions 441*a* and 441*b*, the interference portions 477 are pushed by the first eccentric shaft portions 441*a* and 441*b*, and thus the second developer conveying member 470*a* is moved in an "A" direction.

The first eccentric shaft portions 441*a* and 441*b* of the first developer conveying member 440 are mounted with shock-absorbing members 443. The shock-absorbing members 443 absorb shock generated when the rotating first eccentric shaft portions 441*a* and 441*b* collide with the interference portions 477, thereby preventing damage of the components.

The third conveying part 473 and the fourth conveying part 474 of the second developer conveying member 470*a* are each provided with first elastic member mounting portions 478, and the main frame 310 is provided with second elastic member mounting portions 313 corresponding to the first elastic member mounting portions 478.

The elastic member 470*b* is mounted between each of the first elastic member mounting portions 478 and each of the second elastic member mounting portions 313 in such a manner that one end of the elastic member 470*b* is supported by the first elastic member mounting portion 478 and the other end of the elastic member 470*b* is supported by the second elastic member mounting portion 313. The elastic member 470*b* elastically biases the second developer conveying member 470*a* in a direction opposite to the "A" direction (in a "B" direction).

If the first eccentric shaft portions 441*a* and 441*b* move away from the interference portions 477 of the second developer conveying member 470*a* as the first developer conveying member 440 rotates, the second developer conveying member 470*a* moves in the "B" direction by an elastic force of the elastic member 470*b*. At this time, the developer stored in the first developer storage part 420 is conveyed to the first portion 430*a* of the second developer storage part 430 through the developer paths 461 and 462, and the developer stored in the first portion 430*a* of the second developer storage part 430 is conveyed to the second portion 430*b*.

The main frame 310 has guide protrusions 314, and the second developer conveying member 470*a* has guide slots 479, through which the guide protrusions 314 are respectively inserted. The guide protrusions 314 and the guide slots 479 serve to assist the smooth reciprocating motion of the second developer conveying member 470*a*.

As illustrated in FIGS. 3 and 4, the cover 330 is disposed above the second frame 312 of the main frame 310, and covers the second developer storage part 430 and the developer paths 460.

The cover 330 includes a light-transmitting hole 331 and a protruding wall 332 extending upward from the rear of the light-transmitting hole 331. The light having passed through the light window 340 of the main frame 310 can penetrate the cover 330 through the light-transmitting hole 331. The protruding wall 332 prevents the developer scattering from the developing devices 40Y, 40M, 40C and 40K disposed above the cover 330 from being introduced into the light-transmitting hole 331.

The cover 330 has a knob part 333, which is concavely formed at a rear portion of the cover 330. When a user installs or uninstalls the photosensitive body unit 100 to and/or from the image forming apparatus, the knob part 333 enables a user to easily grasp the photosensitive body unit 100.

As apparent from the above description, an image forming apparatus according to the present general inventive concept can reduce the space occupied by inner components thereof, and can provide a sufficient developer storage space in a photosensitive body unit by forming a developer collecting device integrally with the photosensitive body unit. Further, since the photosensitive body unit is formed with the light window, through which light can pass, an arrangement of a laser scanning unit or the photosensitive body unit is freely achieved. Accordingly, the inner space of the image forming apparatus can be efficiently utilized. As a result, the image forming apparatus can be manufactured compactly.

Further, a user does not need to separately dispose of the developer collected from the photosensitive body. That is, when the photosensitive body unit is replaced, the collected developer is also removed. Accordingly, a user's convenience is enhanced.

Although embodiments of the present general inventive concept have been shown and described, it would be appreciated by those skilled in the art that changes may be made in this embodiment without departing from the principles and spirit of the general inventive concept, the scope of which is defined in the claims and their equivalents.

What is claimed is:

1. A photosensitive body unit, comprising:

a photosensitive body;

a first developer storage part to store a developer collected from the photosensitive body;

a second developer storage part to store a developer conveyed from the first developer storage part without discharging the conveyed developer out of the second developer storage part; and a light window provided between the first developer storage part and the second developer storage part so that light can be scanned to the photosensitive body.

2. The photosensitive body unit according to claim 1, further comprising:

developer paths provided near the light window so that a developer stored in the first developer storage part can be moved to the second developer storage part.

3. The photosensitive body unit according to claim 1, further comprising:

a first developer conveying member disposed in the first developer storage part; and a second developer conveying member disposed in the second developer storage part.

4. The photosensitive body unit according to claim 3, wherein the second developer conveying member is operated interlockingly with the first developer conveying member.

5. The photosensitive body unit according to claim 4, wherein the first developer conveying member performs a rotating motion, and the second developer conveying member performs a rectilinear motion.

6. The photosensitive body unit according to claim 1, further comprising:

a photosensitive body housing to rotatably support the photosensitive body, wherein the first developer storage part and the second developer storage part are formed in the photosensitive body housing.

7. The photosensitive body unit according to claim 6, wherein the light window includes a light-transmitting hole formed at a bottom of the photosensitive body housing, and a side wall protruded upward from a periphery of the light-transmitting hole.

8. The photosensitive body unit according to claim 6, wherein the photosensitive body housing includes a knob part.

9. The photosensitive body unit according to claim 6, wherein the photosensitive body housing includes a cover to cover the second developer storage part.

10. The photosensitive body unit according to claim 9, wherein the cover is formed with a light-transmitting hole so that light having passed through the light window can penetrate the cover.

11. The photosensitive body unit according to claim 9, wherein the cover is provided with a protruding wall to prevent foreign substances from being introduced into the light window.

12. A photosensitive body unit usable with a multi-color image forming apparatus having a plurality of developing devices, the photosensitive body unit comprising:

a photosensitive body housing;

a photosensitive body mounted in the photosensitive body housing, the photosensitive body being disposed to receive developers of different colors from the plurality of developing devices in the multi-color image forming apparatus when the photosensitive body unit is mounted in the multi-color image forming apparatus;

a first developer storage part provided in the photosensitive body housing;

a second developer storage part provided in the photosensitive body housing to store waste developer collected from the photosensitive body;

a light-transmitting hole formed at the photosensitive body housing so that light can be scanned to the photosensitive body; and developer paths provided so that the waste developer stored in the first developer storage part can make a detour to avoid the light-transmitting hole and can move to the second developer storage part.

13. The photosensitive body unit according to claim 12, wherein the developer paths are respectively formed on both side portions of the light-transmitting hole.

14. The photosensitive body unit according to claim 12, further comprising:

a developer conveying member including at least a portion disposed in the developer paths.

15. An image forming apparatus, comprising:

a photosensitive body unit including a photosensitive body and a photosensitive body housing to rotatably support the photosensitive body;

a laser scanning unit to scan light to the photosensitive body; and developing devices to supply a developer to the photosensitive body, wherein the photosensitive body unit further includes a first developer storage part provided in the photosensitive body housing to store a developer collected from the photosensitive body, and a second developer storage part to store a developer moving from the first developer storage part without discharging the moved developer out of the second developer storage part, and the photosensitive body housing includes a light-transmitting hole opened so that light scanned from the laser scanning unit can reach the photosensitive body.

16. The image forming apparatus according to claim 15, wherein the light-transmitting hole is positioned between the first developer storage part and the second developer storage part.

17. The image forming apparatus according to claim 15, wherein the laser scanning unit is disposed below the photosensitive body unit, and the light-transmitting hole is formed at a bottom of the photosensitive body housing.

18. The image forming apparatus according to claim 15, wherein the photosensitive body housing further includes a side wall protruded upward from a periphery of the light-transmitting hole.

19. The image forming apparatus according to claim 18, wherein the photosensitive body unit further includes developer paths provided on outer side portions of the side wall, to connect the first developer storage part and the second developer storage part.

20. An image forming apparatus, comprising:

a photosensitive body unit comprising a single photosensitive body;

a laser scanning unit (LSU) to emit an image-forming light into the photosensitive body unit;

a plurality of developing devices arranged along an outer circumference surface of the single photosensitive body to supply developers of different colors to the single photosensitive body, each of the developing devices including a developer storage part to store a corresponding one of the developers of the different colors, and a developing roller arranged to supply the corresponding developer to the single photosensitive body;

a storage part provided in the photosensitive body unit to store waste developer collected from the single photosensitive body;

a developer path formed on the storage part; and a light window formed in the developer path to allow the image forming light to enter the photosensitive body unit.

21. The image forming apparatus of claim 20, wherein the storage part further comprises:

first and second frame parts, such that the light window is disposed between the first and second frame parts to allow the image-forming light to enter the photosensitive body unit.

22. The image forming apparatus of claim 21, further comprising:

a plurality of developer conveying members disposed in the first and second frame parts to rotatingly or reciprocatingly convey developer from the first frame part to the second frame part.

23. The image forming apparatus of claim 20, wherein the photosensitive body unit further comprises:

a photosensitive body to receive the image-forming light and form an electrostatic latent image corresponding to predetermined image information thereupon.

24. The image forming apparatus of claim 20, further comprising:

a protruding wall disposed on the second frame part to prevent developer from obstructing the image-forming light's entering of the photosensitive body unit.

25. An image forming apparatus, comprising:

a photosensitive body unit comprising first and second developer storage parts;

a light window disposed between the first and second developer storage parts to allow an image forming light to enter the photosensitive body unit;

first and second developer conveying members respectively disposed in the first and second developer storage parts to convey developer from the first developer storage part to the second developer storage part without discharging the conveyed developer out of the second developer storage part while bypassing the light window; and a plurality of developer paths disposed between the first and second developer storage parts to allow the developer to bypass the light window.

* * * * *